US010327981B1

(12) United States Patent
Ayotte

(10) Patent No.: US 10,327,981 B1
(45) Date of Patent: Jun. 25, 2019

(54) MASSAGING DEVICE

(71) Applicant: Nancy Ayotte, Centerville, MA (US)

(72) Inventor: Nancy Ayotte, Centerville, MA (US)

( * ) Notice: Subject to any disclaimer, the term of this patent is extended or adjusted under 35 U.S.C. 154(b) by 359 days.

(21) Appl. No.: 15/340,630

(22) Filed: Nov. 1, 2016

(51) Int. Cl.
*A61H 15/00* (2006.01)
*A61H 7/00* (2006.01)
*A61H 1/00* (2006.01)

(52) U.S. Cl.
CPC ..... *A61H 15/0092* (2013.01); *A61H 1/008* (2013.01); *A61H 2201/0107* (2013.01); *A61H 2201/1253* (2013.01); *A61H 2201/1669* (2013.01); *A61H 2201/1671* (2013.01)

(58) Field of Classification Search
CPC ..... A61H 15/00; A61H 15/0092; A61H 2205/081; A61H 7/003; B25G 1/04; F16B 7/10
See application file for complete search history.

(56) References Cited

U.S. PATENT DOCUMENTS 693,064 A 2/1902 Proben
1,011,498 A * 12/1911 Saphiloff ..... A61H 15/0092 15/188
1,958,936 A * 5/1934 Bajette ..... A61H 15/0092 601/119
2,168,975 A * 8/1939 Clarke ..... A61H 7/003 15/143.1
2,246,263 A * 6/1941 Patterson ..... B43L 17/08 156/579
2,347,327 A * 4/1944 London ..... A61H 15/00 482/132
3,856,002 A * 12/1974 Matsumoto ..... A61H 7/003 601/137
4,210,135 A * 7/1980 Deuser ..... A61H 7/003 601/129
D349,576 S * 8/1994 Heiligenstein ..... D24/200
5,360,111 A * 11/1994 Arispe ..... A45D 34/04 206/361
D363,783 S * 10/1995 Malis ..... D24/214
5,566,418 A * 10/1996 Steffen ..... A47K 7/028 15/144.1
5,664,281 A * 9/1997 Pelfrey ..... A45D 34/04 15/144.1
5,671,497 A * 9/1997 Abdo ..... A45D 34/04 15/144.1

(Continued)

FOREIGN PATENT DOCUMENTS

GB 205989 A 11/1985

*Primary Examiner* — Michael J Tsai
*Assistant Examiner* — Christopher E Miller

(57) ABSTRACT

The massaging device comprises a telescopic handle, a threaded connection, and a plurality of heads. The threaded connection attaches a head selected from the plurality of heads to the telescopic handle. Each of the plurality of heads further comprises a massaging surface. The differences between each of the plurality of heads is defined by differences in the massaging surface. The person places the massaging surface on the portion of the body that requires therapeutic pressure or kneading. The plurality of heads of massaging device pivots allowing the angle of the massaging surface to be changed relative to the body of the person. Each of the plurality of heads is interchangeable.

9 Claims, 7 Drawing Sheets

(56) References Cited

U.S. PATENT DOCUMENTS 5,779,291 A * 7/1998 Forest ..... B25F 1/02 15/105
D415,569 S 10/1999 Wyrwa
6,176,841 B1 * 1/2001 Tso ..... A61H 15/0092 601/129
6,245,031 B1 6/2001 Pearson
6,415,470 B1 * 7/2002 Ramrattan ..... A45D 34/04 15/144.4
6,830,552 B1 * 12/2004 Gonzalez ..... A61H 7/003 601/137
6,988,997 B2 1/2006 Stultz
6,994,680 B1 * 2/2006 Aponte ..... A61H 7/005 601/136
7,169,120 B2 * 1/2007 Murdock ..... A61H 15/0092 601/129
7,309,180 B2 12/2007 Russell
7,337,933 B1 * 3/2008 Klinberg ..... A47G 25/82 223/118
7,698,773 B2 4/2010 Sotelo
9,532,918 B1 * 1/2017 Louis ..... A61H 7/003
2003/0009116 A1 * 1/2003 Luettgen ..... A61H 19/34 601/46
2004/0215115 A1 * 10/2004 Sheen ..... A61H 1/008 601/135
2006/0069333 A1 * 3/2006 Pidcock ..... A61H 15/00 601/123
2006/0142679 A1 * 6/2006 Tan ..... A61H 7/001 601/137
2007/0083135 A1 * 4/2007 Gueret ..... A61H 15/00 601/127
2009/0093743 A1 * 4/2009 Corzine ..... A47K 7/028 601/136
2009/0177126 A1 * 7/2009 Berger ..... A61H 1/00 601/23
2011/0224588 A1 * 9/2011 Grippo ..... A61H 7/003 601/135
2013/0023807 A1 * 1/2013 Hennessey ..... A61H 7/003 601/119
2015/0245977 A1 * 9/2015 Sungarian ..... A61H 15/00 601/118
2015/0374576 A1 * 12/2015 Dagan ..... A61H 7/003 601/119
2016/0136032 A1 * 5/2016 Dakides ..... A61H 15/0092 601/113
2016/0151235 A1 * 6/2016 Yu ..... A61H 15/0092 601/135
2016/0166462 A1 * 6/2016 Conder ..... A61H 15/0092 601/84
2016/0213554 A1 * 7/2016 Possemato ..... A61H 15/0092
2016/0271006 A1 * 9/2016 McGrue ..... A61H 15/0092
2017/0156969 A1 * 6/2017 Fitzsimmons ..... A61H 15/00
2018/0042806 A1 * 2/2018 West ..... A61H 15/0092

* cited by examiner

MASSAGING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical or veterinary science, more specifically, a kneading device configured for use in physical therapy.

SUMMARY OF INVENTION

The massaging device is adapted for use with a body of a person. The massaging device is adapted for use in physical therapy. The massaging device is a device that allows the person to massage portions of the body that are otherwise difficult to reach. The massaging device comprises a telescopic handle, a threaded connection, and a plurality of heads. The threaded connection attaches a head selected from the plurality of heads to the telescopic handle. Each of the plurality of heads further comprises a massaging surface. The differences between each of the plurality of heads is defined by differences in the massaging surface. The person places the massaging surface on the portion of the body that requires therapeutic pressure or kneading. The plurality of heads of massaging device pivots allowing the angle of the massaging surface to be changed relative to the body of the person.

These together with additional objects, features and advantages of the massaging device will be readily apparent to those of ordinary skill in the art upon reading the following detailed description of the presently preferred, but nonetheless illustrative, embodiments when taken in conjunction with the accompanying drawings.

In this respect, before explaining the current embodiments of the massaging device in detail, it is to be understood that the massaging device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the massaging device.

It is therefore important that the claims be regarded as including such equivalent construction insofar as they do not depart from the spirit and scope of the massaging device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
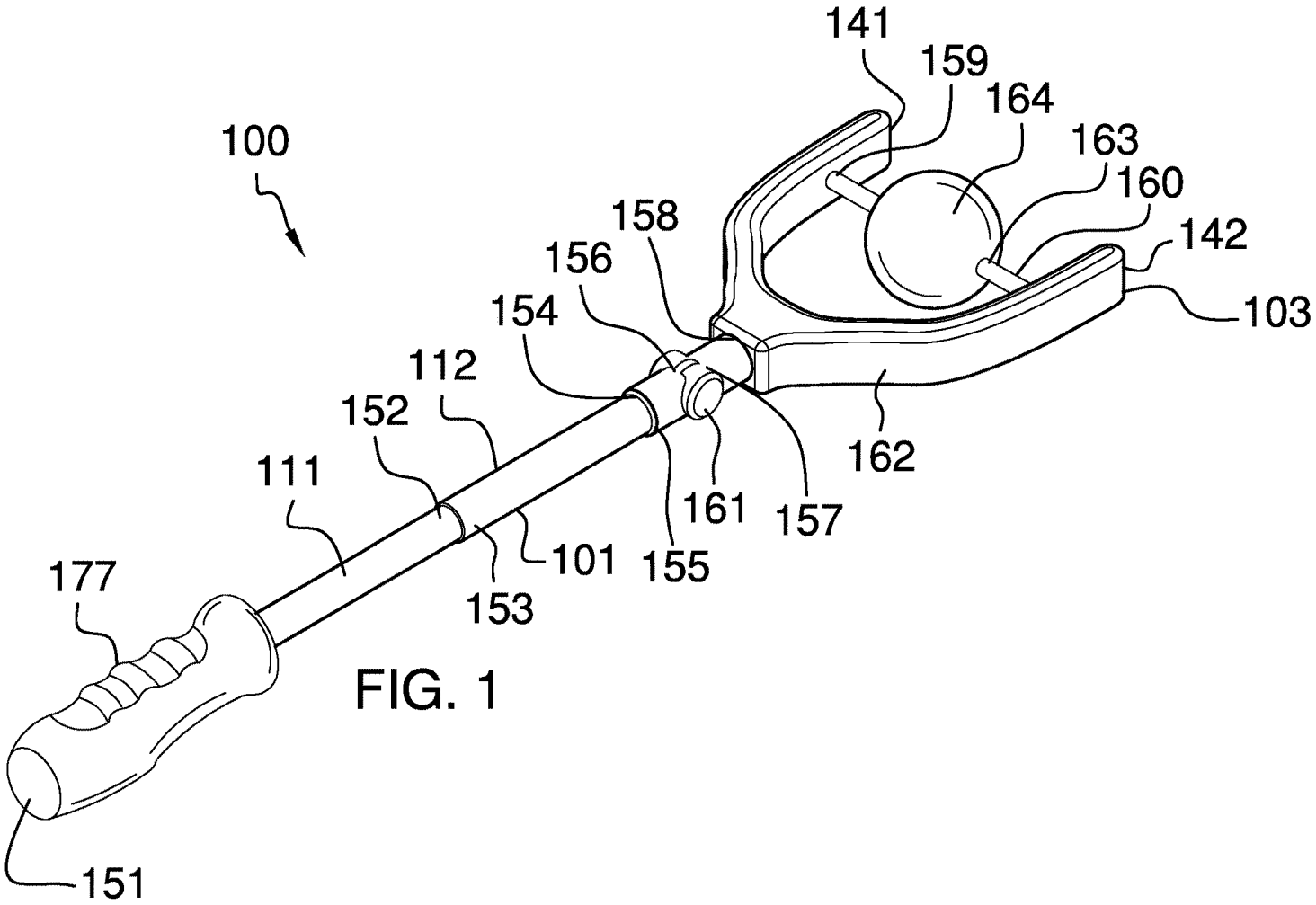
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The massaging device 100 (hereinafter invention) comprises a telescopic handle 101, a threaded connection 102, and a plurality of heads 103. The threaded connection 102 attaches a head selected from the plurality of heads 103 to the telescopic handle 101. The invention 100 is adapted for use with a body 171 of a person. The invention 100 is adapted for use in physical therapy. The invention 100 is a device that allows the person to massage portions of the body 171 that are otherwise difficult to reach. Each of the plurality of heads 103 further comprises a massaging surface 164. The differences between each of the plurality of heads 103 is defined by differences in the massaging surface 164. The person places the massaging surface 164 on the portion of the body 171 that requires therapeutic pressure or kneading. Each of the plurality of heads 103 of invention 100 pivots allowing the angle of the massaging surface 164 to be changed relative to the body 171 of the person. Each of the plurality of heads 103 is interchangeable.

The threaded connection 102 comprises an interior screw thread 121 and an exterior screw thread 122. The interior screw thread 121 is formed into each head selected from the plurality of heads 103. The exterior screw thread 122 is formed on the telescopic handle 101. The exterior screw thread 122 and the interior screw thread 121 are designed to work with each other. To join the telescopic handle 101 to the selected head, the exterior screw thread 122 screws into the interior screw thread 121.

The telescopic handle 101 comprises a first shaft 111, a second shaft 112, and a detent 113. The first shaft 111 is further defined with a first end 151 and a second end 152. The second shaft 112 is further defined with a third end 153 and a fourth end 154. The detent 113 attaches the first shaft 111 to the second shaft 112. The telescopic handle 101 is further defined with an ergonomic handle 177 that is adjacent to the first end 151. The ergonomic handle 177 is adapted to be manually grasped via a hand 178.

The first shaft 111 is a readily and commercially available pipe. The second shaft 112 is a readily and commercially available pipe. As shown most clearly in FIGS. 1 and 2, the outer diameter of the first shaft 111 is lesser than the inner diameter of the second shaft 112 such that the second end 152 of the first shaft 111 will slide into the third end 153 of the second shaft 112 in a telescopic fashion. To adjust the span from the first end 151 of the first shaft 111 to the fourth end 154 of the second shaft 112, the relative position of the second end 152 of the first shaft 111 within the second shaft 112 is changed. The relative position of the second end 152 of the first shaft 111 within the second shaft 112 is locked into position using the detent 113. The detent 113 is a commercially available device that is designed to lock telescopic structures in a fixed relative position. These devices are well known in the mechanical arts. Suitable locking devices for use as the detent 113 include, but are not limited to, a threaded clutch, a split collar, a G snap collar, or a set knob.

Figure 2:
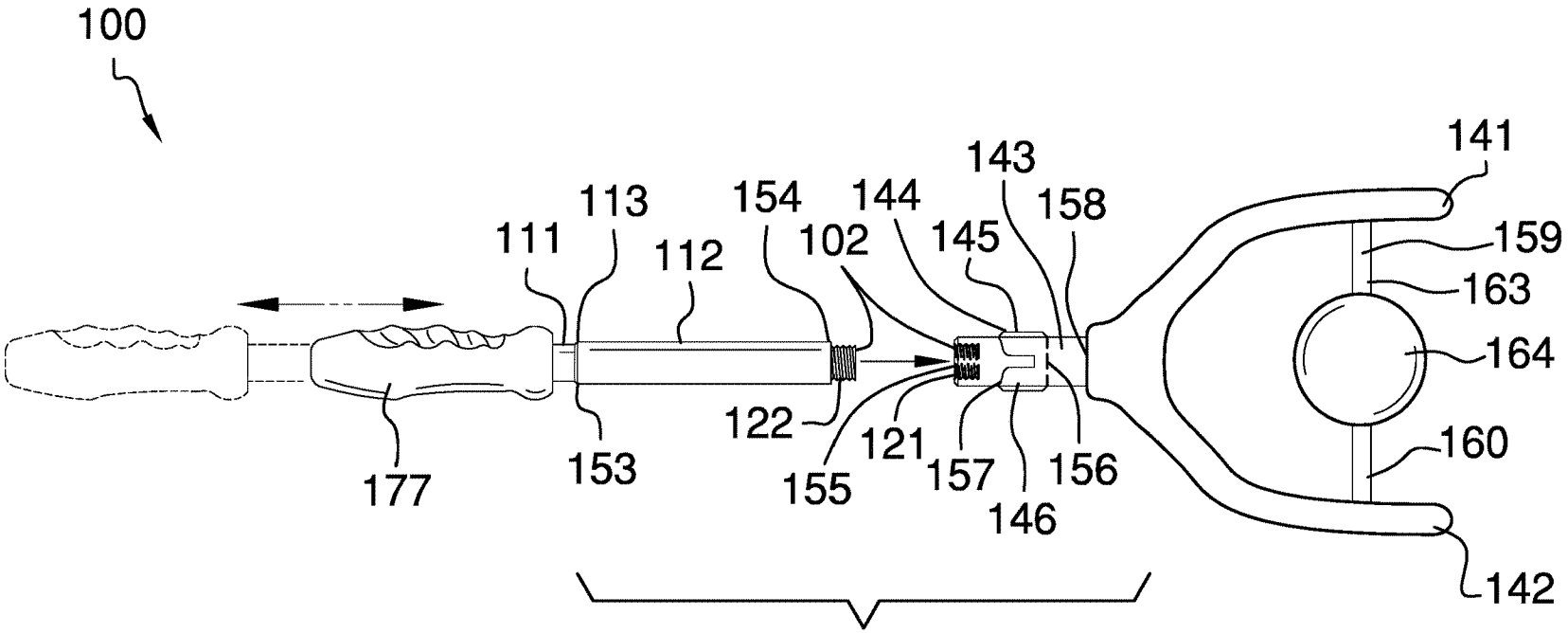
FIG. 2 is a bottom view of an embodiment of the disclosure.
Figure 3:
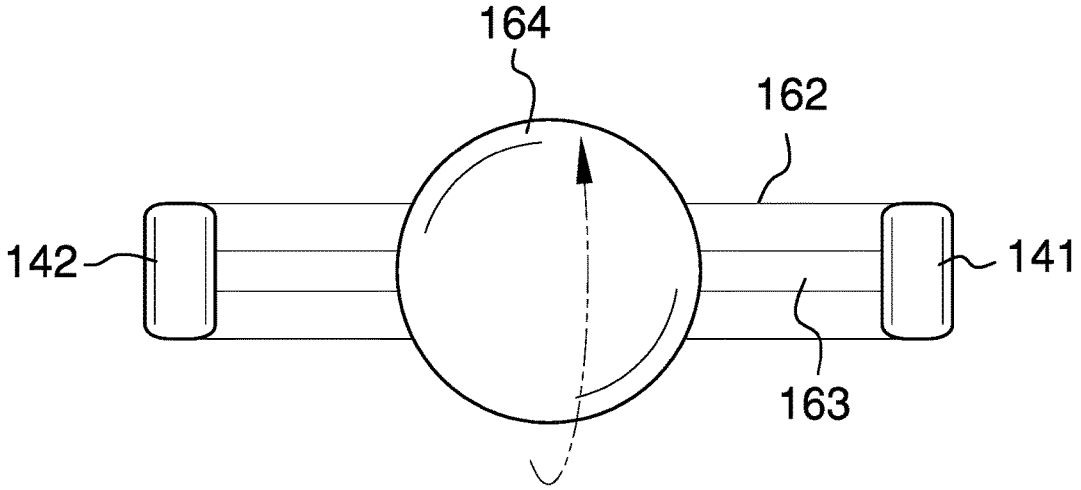
FIG. 3 is a front view of an embodiment of the disclosure.
Figure 4:
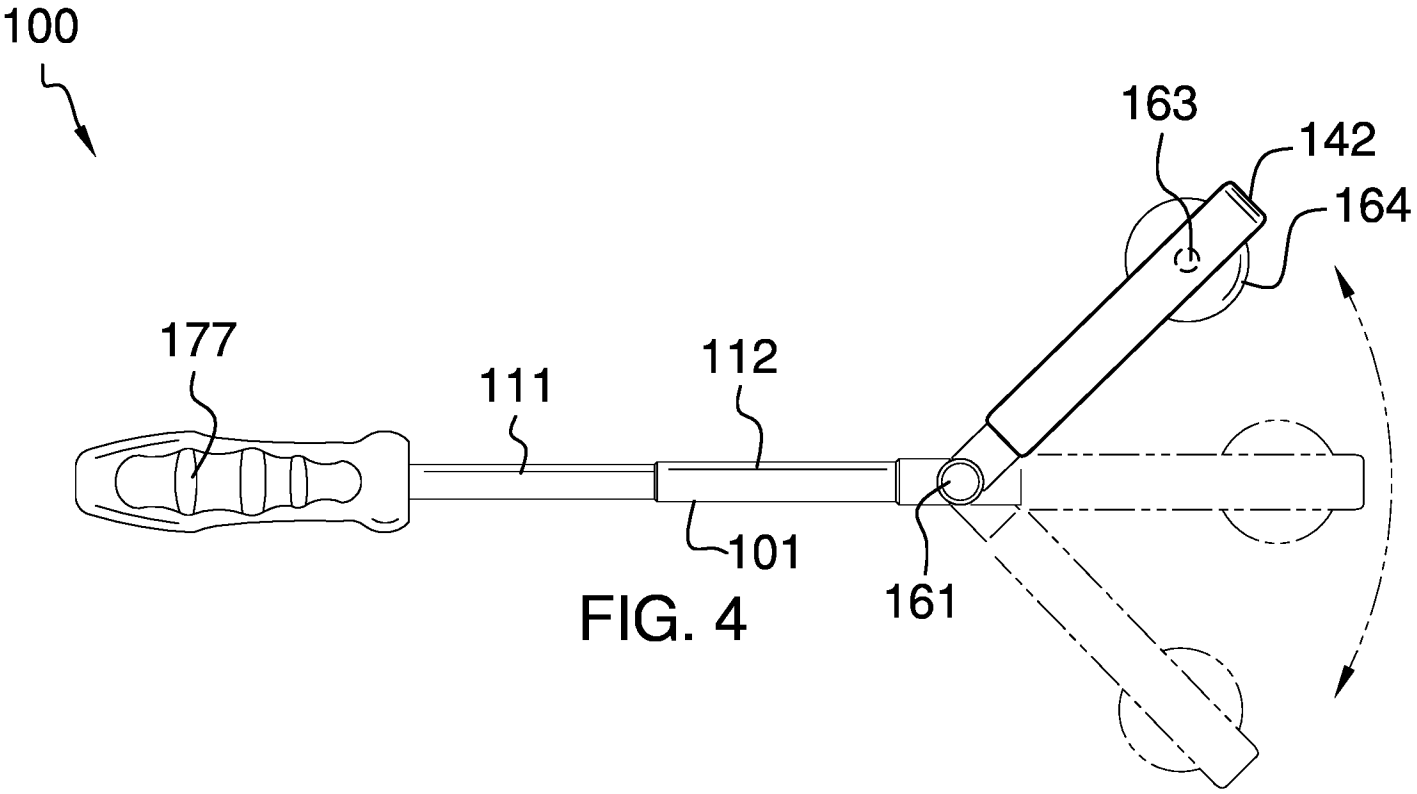
FIG. 4 is a side view of an embodiment of the disclosure.
Figure 5:
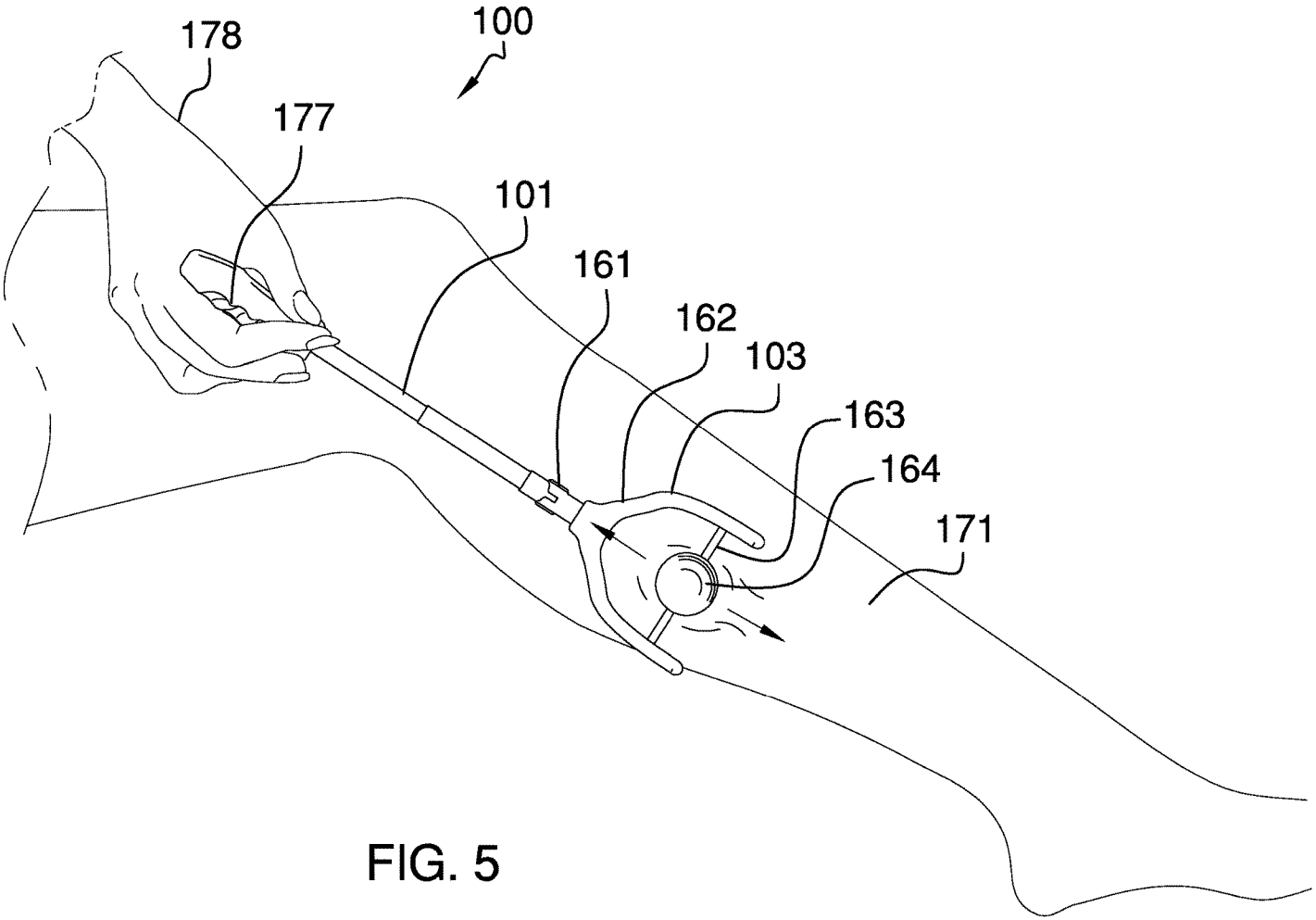
FIG. 5 is an in use view of an embodiment of the disclosure.
Figure 6:
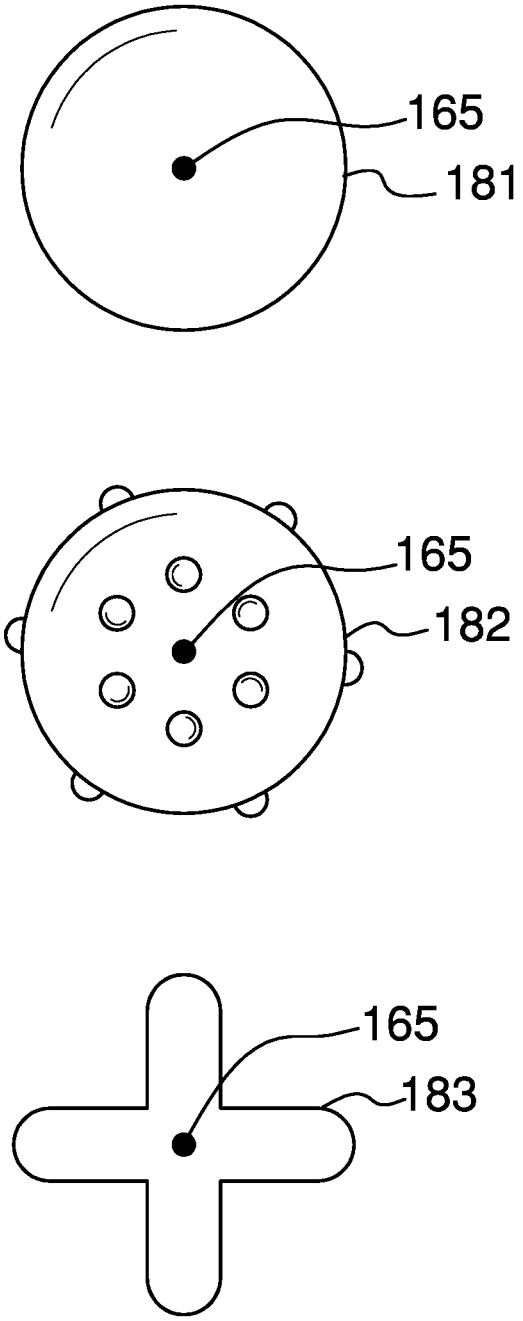
FIG. 6 is a detail view of an embodiment of the disclosure.
Figure 7:
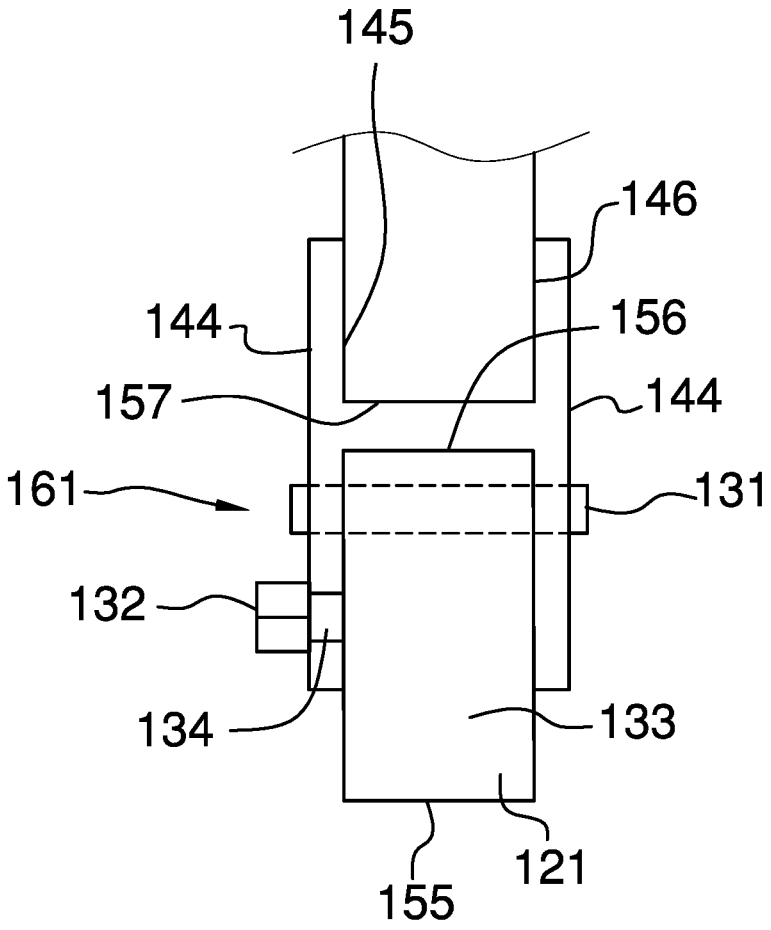
FIG. 7 is a detail view of an embodiment of the disclosure.

As shown most clearly in FIG. 2, the exterior screw thread 122 is formed on the fourth end 154 of the second shaft 112. Each of the plurality of heads 103 comprises a locking pivot 161, a Y base 162, an axle 163 and the massaging surface 164. The axle 163 attaches the massaging surface 164 to the Y base 162. The locking pivot 161 attaches the Y base 162 to the telescopic handle 101. The axle 163 is further defined with a ninth end 159 and a tenth end 160.

The Y base 162 comprises a first arm 141, a second arm 142, a leg 143, and a hood 144. The leg 143 is further defined with a seventh end 157 and an eighth end 158. As shown most clearly in FIG. 2, the first arm 141 and the second arm 142 both project away from the eighth end 158 of leg 143 to form the characteristic Y shape of a slingshot. The hood 144 comprises a first plate 145 and a second plate 146 that are attached to the leg 143 and project beyond the seventh end 157 of the leg 143 towards the stub 133. The use of the hood 144 is described elsewhere in this disclosure.

The locking pivot 161 comprises a pivot shaft 131, a locking mechanism 132, and a stub 133. The stub 133 is further defined with a fifth end 155 and a sixth end 156. The stub 133 attaches to the telescopic handle 101. The pivot shaft 131 attaches the stub 133 to the hood 144. The locking mechanism 132 is a device that prevents the rotation of the hood 144 relative to the stub 133. In the first potential embodiment of the disclosure, the locking mechanism 132 is a set screw 134. The interior screw thread 121 is formed in the fifth end 155 of the stub 133. In the first potential embodiment of the disclosure, as shown most clearly in FIG. 7, the hood 144 is placed around the sixth end 156 of the stub 133 and is attached to the sixth end 156 of the stub 133 using the pivot shaft 131. Methods to attach hoods to shafts using a pivot shaft 131 are well known and documented in the mechanical arts. The locking mechanism 132 is a set screw 134 that is inserted through the side of the first plate 145 into the face of the stub 133.

Each massaging surface 164 is a structure that is designed to provide therapeutic pressure to or therapeutic kneading on the body 171. Each massaging surface 164 is formed with an axle hole 165. The purpose of the axle hole 165 is to receive the axle 163 such that the axle 163 will attach the massaging surface 164 to the Y base 162. The axle hole 165 is sized such that the massaging surface 164 will rotate such that the axle 163 forms the axis of rotation of the massaging surface 164. To attach the massaging surface 164 to the Y base 162, the axle 163 is inserted through the axle hole 165. The ninth end 159 of the axle 163 is attached to the first arm 141. The tenth end 160 of the axle 163 is attached to the second arm 142.

Any head selected from the plurality of heads 103 is differentiated from the heads remaining within the plurality of heads 103 by the structure of the massaging surface 164. In the first potential embodiment of the disclosure, as shown most clearly in FIG. 7, the plurality of heads 103 comprises three heads which are differentiated by: 1) the use of a smooth ball 181 as a first massaging surface, 2) the use of a knobbed 182 surface as a second massaging surface; and, 3) the use of a pinwheel 183 surface as a third massaging surface. The knobbed 182 surface is a spherical surface that further comprises a plurality of knobs. The pinwheel 183 surface comprises a plurality of blades that rotate around the axis.

To use the invention 100, a head is selected from the plurality of heads 103 and is attached to the telescopic handle 101 using the threaded connection 102 as described elsewhere in this disclosure. The length of the telescopic handle 101 is adjusted by adjusting the relative position of the second end 152 within the second shaft 112 as described elsewhere in this disclosure. The relative angle of the Y base 162 to the telescopic handle 101 is adjusted as described elsewhere in this disclosure. The person then uses the telescopic handle 101 to press the massaging surface 164 of the selected head in a therapeutic fashion against the body 171.

In the first potential embodiment of the disclosure, the massaging surfaces 164 are formed from polyurethane. However, it shall be noted that the massaging surface 164 may be a tennis ball. The balance of the invention 100 is formed from molded plastic. Suitable plastics include, but are not limited to, polyethylene, polyvinylchloride, polypropylene, or polycarbonate. A second potential embodiment of the disclosure is identical to the first potential embodiment of the disclosure except that the balance of the invention 100 is formed from aluminum.

The following definitions were used in this disclosure:

Axle: As used in this disclosure, an axle is a cylindrical shaft that is inserted through the center of an object such that the object can rotate using the axle as an axis of rotation.

Ball: As used in this disclosure, a ball refers to an object with a spherical or nearly spherical shape.

Center of Rotation: As used in this disclosure, the center of rotation is the point of a rotating plane that does not move with the rotation of the plane. A line within a rotating three dimensional object that does not move with the rotation of the object is referred to as an axis of rotation.

Detent: As used in this disclosure, a detent is a device for positioning and holding one mechanical part in relation to another in a manner such that the device can be released by force applied to one or more of the parts. Exterior Screw Thread: An exterior screw thread is a ridge wrapped around the outer surface of a tube in the form of a helical structure that is used to convert rotational movement into linear movement.

Handle: As used in this disclosure, a handle is an object by which a tool, object, or door is held or manipulated with the hand.

Inner Diameter: As used in this disclosure, the term inner diameter is used in the same way that a plumber would refer to the inner diameter of a pipe.

Interior Screw Thread: An interior screw thread is a groove that is formed around the inner surface of a tube in the form of a helical structure that is used to convert rotational movement into linear movement.

Outer Diameter: As used in this disclosure, the term outer diameter is used in the same way that a plumber would refer to the outer diameter of a pipe.

Pipe: As used in this disclosure, the term pipe is used to describe a rigid hollow cylinder. While pipes that are suitable for use in this disclosure are often used to transport or conveys fluids or gasses, the purpose of the pipes in this disclosure are structural. In this disclosure, the terms inner diameter of a pipe and outer diameter are used as they would be used by those skilled in the plumbing arts.

Pivot: As used in this disclosure, a pivot is a rod or shaft around which an object rotates or swings.

Shaft: As used in this disclosure, the term shaft is used to describe a rigid cylinder that is often used as the handle of a tool or implement. The terms inner diameter of the shaft and outer diameter of the shaft are used as they would be used by those skilled in the plumbing arts. The definition of shaft explicitly includes solid shafts or shafts that are formed more like pipes with a hollow passage through the shaft that runs along the center axis of the shaft cylinder.

Telescopic: As used in this disclosure, telescopic is an adjective that describes an object made of sections that fit or slide into each other such that the object can be made longer or shorter by adjusting the relative positions of the sections.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A therapeutic device comprising:

a telescopic handle, a threaded connection, and a plurality of heads;

wherein the threaded connection attaches a head selected from the plurality of heads to the telescopic handle;

wherein the therapeutic device is adapted for use with a body of a person;

wherein the therapeutic device is adapted for use in physical therapy;

wherein the therapeutic device is a device that is adapted to enable a person to massage the body;

wherein each of the plurality of heads further comprises a massaging surface;

wherein the massaging surface is adapted to be placed on the portion of the body that requires therapeutic treatment;

wherein each of the plurality of heads pivots;

wherein each of the plurality of heads is interchangeable;

wherein the threaded connection comprises an interior screw thread and an exterior screw thread;

wherein the interior screw thread is formed into each head selected from the plurality of heads;

wherein the exterior screw thread is formed on the telescopic handle;

wherein the exterior screw thread screws into the interior screw thread;

wherein the telescopic handle comprises a first shaft, a second shaft, and a detent;

wherein the first shaft is further defined with a first end and a second end;

wherein the second shaft is further defined with a third end and a fourth end;

wherein the detent attaches the first shaft to the second shaft;

wherein the telescopic handle is further defined with an ergonomic handle that is adjacent to the first end;

wherein the ergonomic handle is adapted to be manually grasped via a hand;

wherein the first shaft is a pipe;

wherein the second shaft is a pipe;

wherein the outer diameter of the first shaft is lesser than the inner diameter of the second shaft;

wherein the second end of the first shaft slides into the third end of the second shaft in a telescopic fashion;

wherein the relative position of the second end of the first shaft within the second shaft is locked into position using the detent;

wherein the exterior screw thread is formed on the fourth end of the second shaft;

wherein each of the plurality of heads comprises a locking pivot, a Y base, an axle and the massaging surface;

wherein the axle attaches the massaging surface to the Y base;

wherein the locking pivot attaches the Y base to the telescopic handle;

wherein the axle is further defined with a ninth end and a tenth end;

wherein the Y base comprises a first arm, a second arm, a leg, and a hood;

wherein the leg is further defined with a seventh end and an eighth end;

wherein the first arm projects away from the eighth end of leg;

wherein the second arm projects away from the eighth end of leg;

wherein the first arm and the second arm form a Y shape;

wherein the hood is attached to the seventh end;

wherein the hood comprises a first plate and a second plate;

wherein the first plate is attached to the leg such that the first plate projects beyond the seventh end of the leg towards a stub;

wherein the second plate is attached to the leg such that the second plate projects beyond the seventh end of the leg towards the stub;

wherein the locking pivot comprises a pivot shaft, a locking mechanism, and the stub;

wherein the stub is further defined with a fifth end and a sixth end;

wherein the stub attaches to the telescopic handle;

wherein the pivot shaft attaches the stub to the hood;

wherein the locking mechanism is a device that enables the rotation of the hood relative to the stub.

2. The therapeutic device according to claim 1 wherein the interior screw thread is formed in the fifth end of the stub.

3. The therapeutic device according to claim 2 wherein the hood is placed around the sixth end of the stub;

wherein the hood attaches to the sixth end of the stub using the pivot shaft.

4. The therapeutic device according to claim 3 wherein the massaging surface of each head selected from the plurality of heads is formed with an axle hole;

wherein the axle hole receives the axle such that the axle attaches the massaging surface to the Y base.

5. The therapeutic device according to claim 4 wherein the axle hole is sized such that the massaging surface will rotate such that the axle forms an axis of rotation for the massaging surface.

6. The therapeutic device according to claim 5 wherein the ninth end of the axle is attached to the first arm;

wherein the tenth end of the axle is attached to the second arm.

7. The therapeutic device according to claim 6 wherein the plurality of heads comprises a first head and a second head;

wherein the massaging surface of the first head is a ball;

wherein the massaging surface of the second head is a knobbed surface;

wherein the knobbed surface is a spherical structure formed with a plurality of knobs.

8. The therapeutic device according to claim 7 wherein the plurality of heads further comprises a third head;

wherein the massaging surface of the third head is a pinwheel;

wherein the pinwheel comprises a plurality of blades.

9. The therapeutic device according to claim 7 wherein the locking mechanism is a set screw;

wherein the set screw is inserted through the side of the first plate into the face of the stub.

* * * * *